US008276242B2

(12) United States Patent
Girard et al.

(10) Patent No.: US 8,276,242 B2
(45) Date of Patent: Oct. 2, 2012

(54) ADJUSTABLE HANDLE ASSEMBLY WITH LOCKING MECHANISM

(76) Inventors: Mylène Girard, Carignan (CA); Charles Vallières, Carignan (CA)

( * ) Notice: Subject to any disclaimer, the term of this patent is extended or adjusted under 35 U.S.C. 154(b) by 198 days.

(21) Appl. No.: 12/757,453

(22) Filed: Apr. 9, 2010

(65) Prior Publication Data

US 2011/0247175 A1 Oct. 13, 2011

(51) Int. Cl.
*A45C 3/00* (2006.01)
*B25G 1/00* (2006.01)

(52) U.S. Cl. ..... 16/438; 16/436; 16/900

(58) Field of Classification Search ..... 16/438, 16/436, 444, 445, 421, 426, 324, 326; 24/591.1, 24/595.1, 593.11; 74/526–528, 545–547, 74/536, 537; 81/177.1, 177.8, 177.9, 177.75, 81/489; 403/17, 150, 94, 97, 322.1, 322.2; 248/187.1, 186.1, 176.3; 280/655, 655.1, 280/47.371, 47.315; 408/14, 72 R, 241 R; 396/419, 420, 428
See application file for complete search history.

(56) References Cited

U.S. PATENT DOCUMENTS

| | | | | |
|---|---|---|---|---|
| 2,746,369 | A | 5/1956 | Beard et al. | |
| 3,459,064 | A | 8/1969 | O'Gara | |
| 3,948,549 | A * | 4/1976 | Duran | 292/26 |
| 4,389,675 | A | 6/1983 | Suzuki et al. | |
| 4,621,805 | A * | 11/1986 | Chen | 482/57 |
| 5,168,601 | A * | 12/1992 | Liu | 16/445 |
| 5,301,570 | A * | 4/1994 | Li | 74/551.1 |
| 5,394,594 | A * | 3/1995 | Duran | 24/453 |
| 5,585,849 | A | 12/1996 | Robalino | |
| 5,586,363 | A * | 12/1996 | Fanuzzi | 16/342 |
| 5,742,859 | A | 4/1998 | Acker | |
| 5,806,734 | A | 9/1998 | Scott | |
| 5,890,025 | A * | 3/1999 | Hart | 396/420 |
| 6,017,010 | A | 1/2000 | Cui | |
| 6,068,223 | A * | 5/2000 | Navarro | 248/187.1 |
| 6,149,112 | A | 11/2000 | Thieltges | |

(Continued)

FOREIGN PATENT DOCUMENTS

| | | |
|---|---|---|
| CA | 1316033 | 4/1993 |
| CA | 2605034 | 10/2006 |

(Continued)

OTHER PUBLICATIONS

PCT—International Search Report (ISR)—PCT/CA2011/000348 (Form PCT/ISA/210)—Jun. 29, 2011—4 pages.

*Primary Examiner* — Chuck Y. Mah
(74) *Attorney, Agent, or Firm* — Benoît & Côté

(57) ABSTRACT

The present document describes a pivotable handle assembly for mounting on a support. The assembly comprises a rotation-blocking portion comprising a pivot axis, the rotation-blocking portion for being rotatable about the pivot axis and relative to the support when in an unlocked position, and when in a locked position, the rotation blocking portion for preventing its rotation about the pivot axis; a handle depending from the rotation blocking portion; and a locking mechanism comprising a push-button and a lock release. The locking mechanism is for locking the rotation-blocking portion in the locked position, and for unlocking the rotation-blocking portion in the unlocked position upon a pushing motion being applied to the push-button to actuate the lock release, the unlocked position thereby allowing the handle to be pivoted about the pivot axis.

11 Claims, 7 Drawing Sheets

U.S. PATENT DOCUMENTS

| | | | | |
|---|---|---|---|---|
| 6,173,860 | B1 | 1/2001 | Lamers | |
| 6,499,172 | B1 * | 12/2002 | McCracken | 15/97.1 |
| 6,789,292 | B2 * | 9/2004 | Oshima et al. | 16/297 |
| 6,948,197 | B1 * | 9/2005 | Chen | 5/93.1 |
| 7,128,419 | B2 | 10/2006 | Harris | |
| 7,563,038 | B2 | 7/2009 | Hershenzon | |
| 7,574,768 | B2 * | 8/2009 | Morris et al. | 15/145 |
| 2002/0168189 | A1 | 11/2002 | Mulcahy | |
| 2002/0179787 | A1 | 12/2002 | Nakatani | |
| 2004/0223078 | A1 | 11/2004 | Zadok | |
| 2007/0248351 | A1 * | 10/2007 | Desorbo | 396/420 |

FOREIGN PATENT DOCUMENTS

| | | | |
|---|---|---|---|
| CA | 2622424 | | 9/2008 |
| CA | 1163446 | | 7/2011 |
| CN | 2700919 | | 5/2005 |
| DE | 10216888 | A1 * | 11/2003 |
| FR | 2624086 | A2 * | 6/1989 |
| FR | 2802107 | A1 * | 6/2001 |
| GB | 2331479 | A * | 5/1999 |
| GB | 2387538 | | 8/2006 |
| WO | WO 96/15404 | | 5/1996 |

* cited by examiner

ADJUSTABLE HANDLE ASSEMBLY WITH LOCKING MECHANISM

CROSS-REFERENCE TO RELATED APPLICATIONS

This application is the first disclosure of this subject matter.

TECHNICAL FIELD

This description relates to the field of adjustable handles. More particularly, this description relates to pivotable handles having a locking mechanism unlockable to allow a pivoting of the handle.

BACKGROUND

Typically available handles which can be adjusted in position are limited in terms of simplicity and ease with which the handle can be adjusted. For example, some existing pivotable handles are only adjustable in position once they are unscrewed to release an initial tension retaining the handle in a fixed position. The unscrewing is done by rotating the handle about its axis to unscrew a retaining rod for example. Only then can the handle be moved to a chosen position. To retain the chosen position, a user then has to re-screw the handle in tension.

Other types of handles which are easier to adjust do not provide sufficient granularity in the control of the position of the handle.

There is therefore a need for an improved pivotable handle assembly which allows the adjusting of the handle's position as desired, via a simple and easy manipulation which can be performed single-handedly.

SUMMARY

The present disclosure thus seeks to provide a pivotable handle assembly which addresses one or more of the limitations associated with the prior art, or at least provide a useful alternative.

According to an embodiment, there is provided a pivotable handle assembly for mounting on a support. The assembly comprises a rotation-blocking portion comprising a pivot axis, the rotation-blocking portion for being rotatable about the pivot axis and relative to the support when in an unlocked position, and when in a locked position, the rotation blocking portion for preventing its rotation about the pivot axis; a handle depending from the rotation blocking portion; and a locking mechanism comprising a push-button and a lock release. The locking mechanism is for locking the rotation-blocking portion in the locked position, and for unlocking the rotation-blocking portion in the unlocked position upon a pushing motion being applied to the push-button to actuate the lock release, the unlocked position thereby allowing the handle to be pivoted about the pivot axis.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
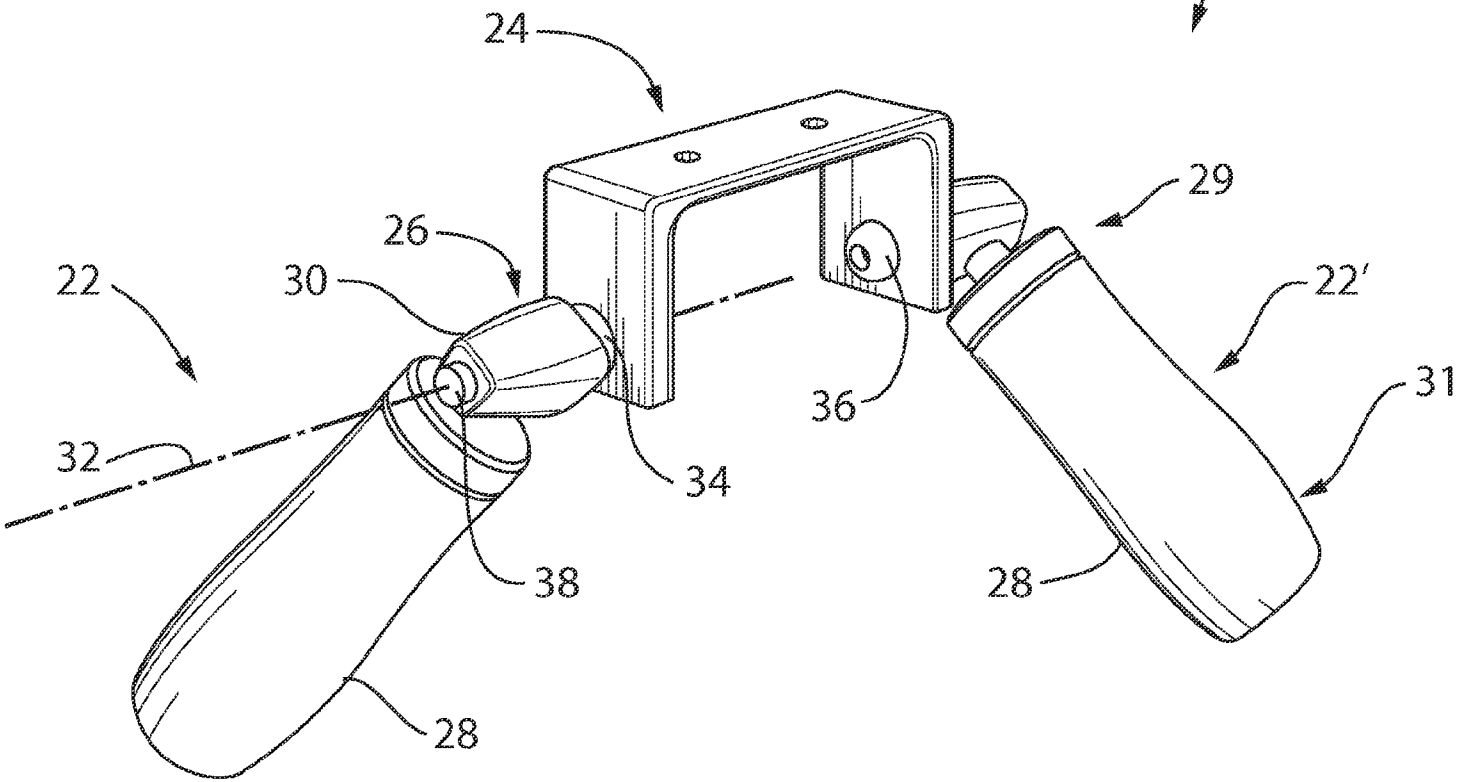
FIG. 1 is a perspective schematic illustration of a supporting apparatus comprising two pivotable handle assemblies in accordance with an embodiment.

FIG. 1 shows a support 20 comprising two pivotable handle assemblies 22 and 22' in accordance with an embodiment.

The handle assemblies 22, 22' are mounted to a support bar 24 of any shape desired. There need not be two handle assemblies as shown; any number can be installed to the support bar 24, as desired. The support bar 24 can be any type of bar forming part of the support 20. In another embodiment not shown, the support 20 includes more than one such support bar 24.

In addition, the support 20 can be any type of supporting device for supporting any type of equipment, such as camera equipment or any other element with a given weight in need of support for example. The support 20 can also take the form of an exercising apparatus, a mechanical tool or machinery part, or any other type of supporting device where an adjustable handle pivot as herein described is desirable.

In the illustrated embodiment of FIG. 1, as both the handle assemblies 22 and 22' are similar, only handle assembly 22 is described below.

The handle assembly 22 has a rotation-blocking portion 26, a locking mechanism (not shown) and a handle 28 depending from the rotation-blocking portion 26, a distal end 30 thereof.

The rotation-blocking portion 26 comprises a pivot axis 32, about which it is rotatable relative to the support bar 24 when the assembly is in an unlocked position. Otherwise, when in a locked position, the rotation-blocking portion 26 prevents any rotation from occurring.

In addition, when the handle assembly 22 is in an unlocked position, the rotation-blocking portion 26 is moveable away from the support bar 24. Inversely, when in the locked position, the rotation-blocking portion 26 is locked onto the support bar 24 and such that no rotation is made possible.

Although not shown in FIG. 1, an inner tube extending along the pivot axis 32 is used to secure the support bar 24 to the rotation-blocking portion 26, while still allowing their rotation relative to one another when in the unlocked position. Any affixing device such as a screw or a bolt 36 with washer 37 (only shown in FIGS. 2 and 3) is used to secure the handle assembly 22 to the support bar 24.

Figure 2:
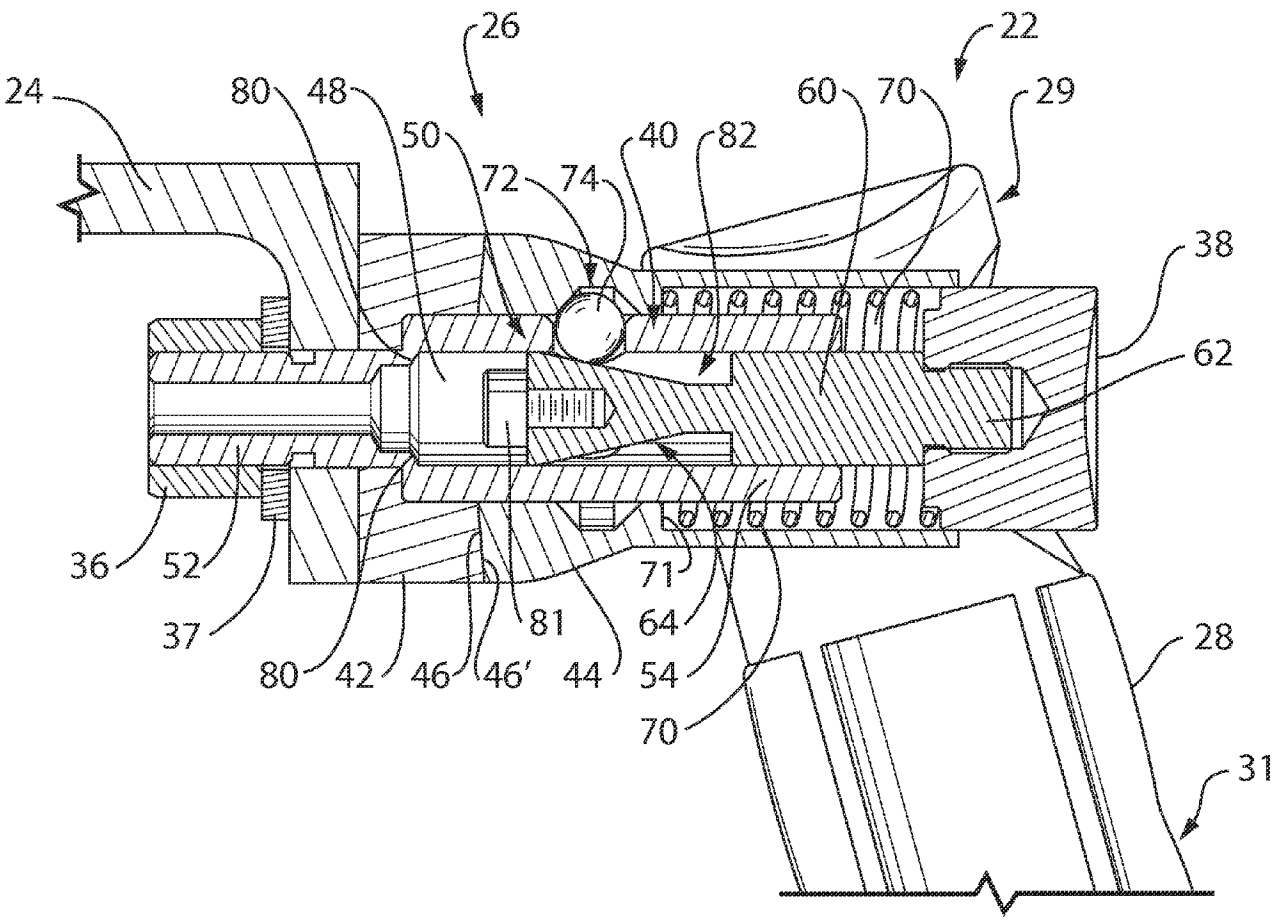
FIG. 2 is a cross-sectional view of a locking mechanism of any one of the pivotable handle assemblies of FIG. 1, in a locked position.
Figure 3:
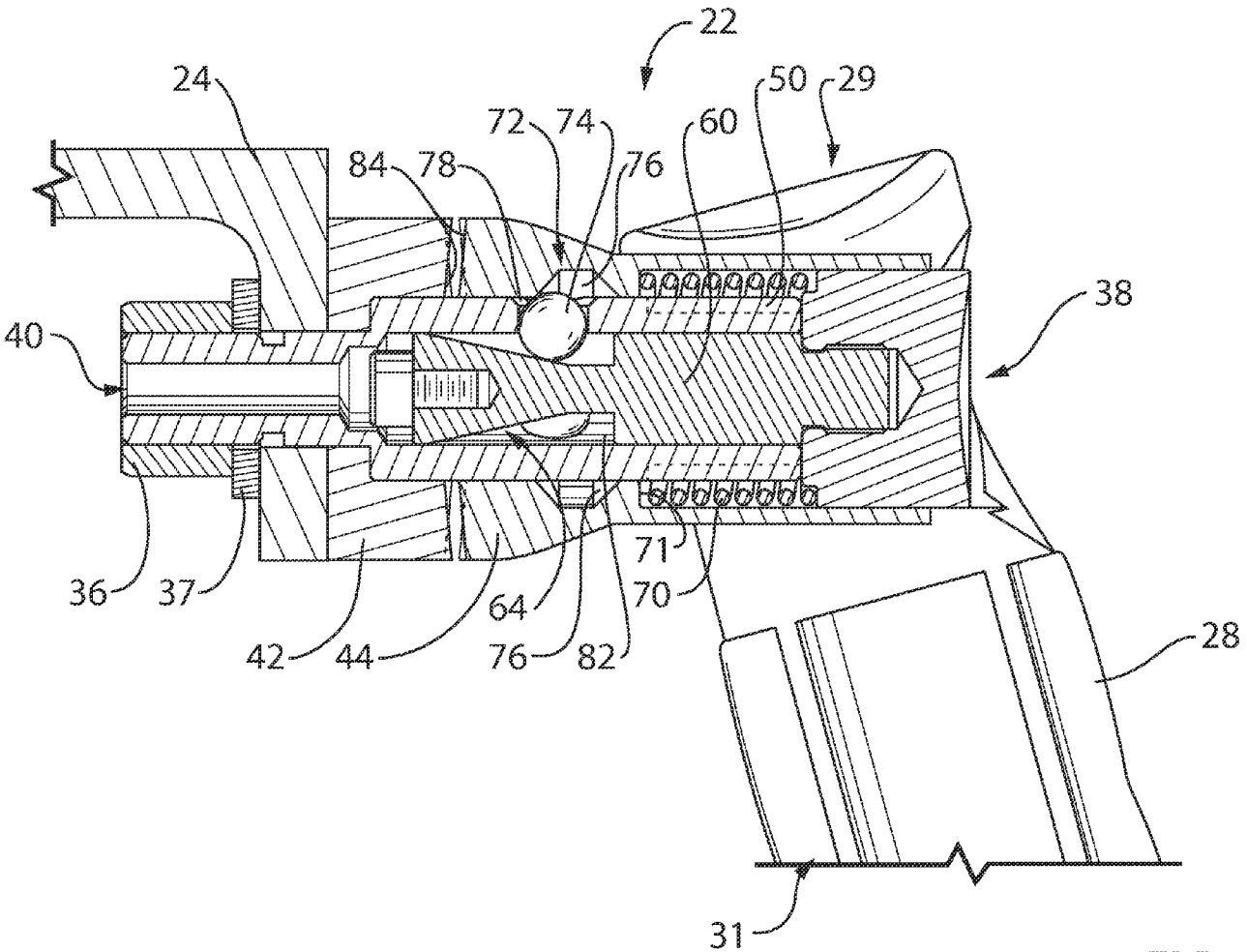
FIG. 3 is a cross-sectional view of the locking mechanism of FIG. 2, in an unlocked position.

Although not shown in FIG. 1, the locking mechanism is defined at least partially within the rotation-blocking portion 26. The locking mechanism, as will be detailed in accordance with the embodiment shown in FIGS. 2 and 3, is for locking and unlocking the handle assembly 22 from its locked position to its unlocked position.

The unlocking and locking is performed by actuating a push-button 38 at the distal end 30 of the handle assembly 22.

More specifically, the button 38, upon being pushed towards the rotation-blocking portion 26 by a user applying a pushing motion thereon, unlocks the handle assembly 22 such that the handle 28 is capable of being pivoted by the user about the pivot axis 32, via the rotation of the rotation-blocking portion 26 relative to the support bar 24.

Still referring to FIG. 1, the handle 28 has an upper portion 29 and a lower portion 31. The upper portion 29 communicates with the distal end 30, while the lower portion 31 is provided to grip the handle 28. Although the handle 28 is shown to depend radially outward from the distal end 30, in another embodiment not shown, the handle 28 depends outwardly, along the pivot axis 32.

As will be described later, in accordance with one embodiment, the support bar 24 has an interlocking surface 34 which is able to interlock with the rotation-blocking portion 26 when in the locked position. The rotation-blocking portion 26 also defines a surface. In one embodiment, this interlocking surface is provided by an interlocking portion (not shown) mounted to the support bar 24.

In one embodiment, the rotation-blocking portion 26 is able to prevent any rotation about the pivot axis 32 and relative to the support bar 24 by having a rotation blocking element (not shown). This element can be a rubber band, grooves or any other friction providing element which is able to stop any rotation via friction occurring at an interface between the support bar 24 and the rotation-blocking portion 26 for example. Alternatively, this rotation blocking element is provided by the interlocking surface 34.

Now referring to FIG. 2, there is shown a cross-sectional view of a locking mechanism 40 of any one of the pivotable handle assemblies 22 or 22' of FIG. 1, in a locked position (also referred to a depressed/released position of the push button 38).

As shown in this embodiment, the rotation-blocking portion 26 of FIG. 1 is embodied as an interlocking portion 44 having an interlocking surface 46 for interlocking with the interlocking surface 46' provided by a second interlocking portion 42. The two interlocking portions 42 and 44 rotatively interlock at an interface between their respective interlocking surfaces 46 and 46' when in the locked position.

More specifically, when the handle assembly 22 is in a locked position, the interlocking portions 42 and 44 prevent rotation by their interlocking surfaces 46 and 46' being joined together. In this way, any rotational movement of one of the interlocking portions 42, 44 with respect to the other one of the interlocking portions 42 and 44 is blocked.

The locking mechanism 40 responsible for the switching between the locked and unlocked position is defined between the interlocking portions 42 and 44, here partially within each one of the two interlocking portions 42 and 44 so as to allow the interlocking portions 42 and 44 to interlock with one another at their interlocking surfaces 46 and 46'.

More specifically in this embodiment, the locking mechanism 40 has an inner bore 48 extending along the pivot axis 32, and as defined by an elongated hollow tube 50. The tube 50 extends at one proximal end 52 into a portion of the support bar 24 so as to fixedly attach the proximal end 34 of the interlocking portion 42 thereto. A washer 37 and bolt 36 are used to attach the tube 50 to the support bar 24. The opposite end 54 of the tube 50 extends into an upper portion 29 of the handle 28. The tube 50 is fixed to the interlocking portion 42, while the interlocking portion 44 is able to rotate over the tube 50.

It is noted that in this embodiment, the handle 28 is fixedly mounted to the distal end 30 of the interlocking portion 44, which also extends into the upper portion 29 of the handle.

The locking mechanism 40 has a plunger 60 having a distal end 62 and an opposite proximal end 64. The plunger 60 is for moving into the bore 48 formed by the tube 50. The moving of the plunger 60 inside the bore 48 is performed by the application of a lateral force onto the plunger 60, from its distal end 62. Such a force is provided by the actuation of the push-button 38, which communicates with the locking mechanism 40 so as to transfer a pushing motion applied thereto to the plunger 60.

More specifically, in the embodiment illustrated in FIGS. 2 and 3, the push-button 38 is positioned over the distal end 62 of the plunger 60. In the locked position as seen in FIG. 2, a biasing device such as one or more springs 70, biases the push-button 38 outwardly of the tube 50 to in turn bias the locking mechanism 40 in the locked position. The biasing device (in this instance, the springs 70) is positioned between the push-button 38 and a biasing stop 71 defined in the interlocking portion 44.

When no pushing motion is applied to the push-button 38, the button 38 pulls the plunger 60 out of the tube 50, away and outwardly of the interlocking portion 44 (or the support bar 24).

To switch to the unlocked position, as seen in FIG. 3, a pushing motion is applied by a user onto the button 38. Similarly, the button 38 communicates the pushing motion to the distal end 62 of the plunger 60, which in turn moves inside the bore 48, towards the interlocking portion 42 (or the support bar 24), and along the pivot axis 32.

Still referring to FIGS. 2 and 3, the locking mechanism 40 has a lock release 72. The inward and outward motions of the plunger 60 in turn actuate the lock release 72 into one of two positions responsible for locking and unlocking the handle assembly 22.

For example, in one position of the lock release 72 as seen in FIG. 2, the assembly is locked: the interlocking portion 44 (with the handle 28 appended thereto) cannot be pulled away from the interlocking portion 42 so as to separate the interlocking portions 42 and 44 from one another at their interlocking surfaces 46 and 46'. Since the interlocking surfaces 46 and 46' are kept joined together, they lock both interlocking portions 42 and 44 together, which blocks any rotation to occur about pivot axis 32.

In a second position of the lock release 72, as seen in FIG. 3, the handle assembly 22 is unlocked: the interlocking portion 44 with the handle 28 are allowed to be pulled away from the interlocking portion 42, which separates the interlocking portions 42 and 44 at their interlocking surfaces 46 and 46'. The interlocking portions 42 and 44 are thus free to move and rotate relative to each other.

Still referring to both FIGS. 2 and 3, in the illustrated embodiment, the lock release 72 has a retaining piece of material such as a ball bearing 74, which is moveable partially into an internal recess 76 of the interlocking portion 44, and partially into the bore 48 of the tube 50, through an opening 78 defined in the tube 50 adjacent the internal recess 76.

When the button 38 is released (i.e. no pushing motion is applied thereto), as in FIG. 2, the locking mechanism 40 is biased into the locked position: the plunger 60 is pulled outwardly along the pivot axis 32, away from the interlocking portion 42 (or the support bar 24). This outward motion in turn moves the ball bearing 74 through the opening 78, and maintains it partially into the internal recess 76. The ball bearing 74 when in this position effectively blocks the interlocking portion 44 (with the appended handle 28) from being moved laterally along the pivot axis 32, away from the interlocking portion 42 (or the support bar 24). In this way, the interlocking portions 42 and 44 are kept locked together at their interlocking surfaces 46, 46'.

When the button 38 is depressed (i.e. via the application of a pushing motion thereto) as in FIG. 3, the locking mechanism 40 moves from the locked position to the unlocked position: the plunger 60 is moved inwardly along the pivot axis 32, towards the interlocking portion 42. This inward motion in turn moves the ball bearing 74 out of the internal recess 76, through the opening 78, and partially into the bore 48 of the tube 50. The ball bearing 74 when in this position effectively allows the interlocking portion 44 (with the appended handle 28) to be moved laterally along the pivot axis 32, away from the interlocking portion 42 (or the support bar 24). In this way, the interlocking portions 42 and 44 are separated from one another to distance their respective interlocking surfaces 46 and 46' as seen in FIG. 3. This distancing of the interlocking surfaces 46, 46' allows the interlocking portions 42 and 44 to be rotated with respect to one another, and thereby allow the rotation of the handle 28 about the pivot axis 32.

As seen in FIGS. 2 and 3, the plunger 60 has a recessed portion 82 closest the proximal end 64 thereof. In the illustrated case, the proximal end 64 is inwardly slanted towards the distal end 62 of the plunger 60. This recessed portion 82 ensures that the ball bearing 74 is able to transit sufficiently into the bore 48 when the plunger 60 moves inwardly, to free the internal recess 76 and unlock the handle assembly 22. Similarly, the recessed portion 82 ensures that the ball bearing 74 is able to transit sufficiently into the internal recess 76 upon the plunger 60 being moved back outwardly by the springs 70. In this way, the ball bearing 74 locks with the interlocking portion 44 of the handle assembly 22.

It is noted that in the above described embodiment, the diameter of the opening 78 is slightly larger than the diameter of the ball bearing 74 so as to limit any looseness in the locking mechanism 40. The size of the internal recess 76 is also set in accordance with the size of the ball bearing 74.

In addition, the tube 50 can be provided with multiple such openings 78; the interlocking portion 44 with multiple internal recesses 76, for use with multiple ball bearings 74. In the illustrated embodiment, although only two of each are shown by the cross-sectional views of FIGS. 2 and 3, the lock release 72 has three of each ball bearing 74, internal recess 76 and opening 78. In addition the recessed portion 82 defined opposite of the distal end 62 of the plunger 60 is formed in one embodiment, by a cone-shaped end of the plunger 60.

Still in reference to the embodiment of FIGS. 2 and 3, it is noted that in one embodiment, a stop 80 is provided inside the bore 48 to limit the inward motion of the plunger 60 inside the bore 48. The stop can be provided by the internal shape of the bore 48, or by an internal rim affixed inside the tube 50. Such a stop in turn provides a reaction force onto the plunger 60, which in turn ensures that the interlocking portion 44, with the handle 28, is free of movement relative to the support bar 24 (similarly relative to the interlocking portion 42 with its interlocking surface 46').

In one embodiment, the interlocking portions 42 and 44 each comprise indentations 84 at their respective interlocking surfaces 46, 46'. Such indentations 84 cooperate with one another to lock the interlocking portions 42, 44 together in the locked position when the surfaces 46, 46' are joined. These indentations can take the form of alternating protrusions and grooves, or gears.

The above described locking mechanism 40 can be made from parts of different materials such as steel and plastic. In one embodiment, at least the tube 50, the plunger 60 and the ball bearing 74 are made of stainless steel. A metal lining can also be provided to solidify the internal recess 76 of the lock release 72. Other variants can also be implemented as per desired practicalities.

Still referring to FIGS. 2 and 3, in one embodiment, the tube 50 provides an access to the plunger 60 via the proximal end 52. For example, an alan key can be inserted into the tube 50 for adjustment purposes during manufacturing of the handle assembly 22, or to adjust the plunger once installed.

Figure 4:
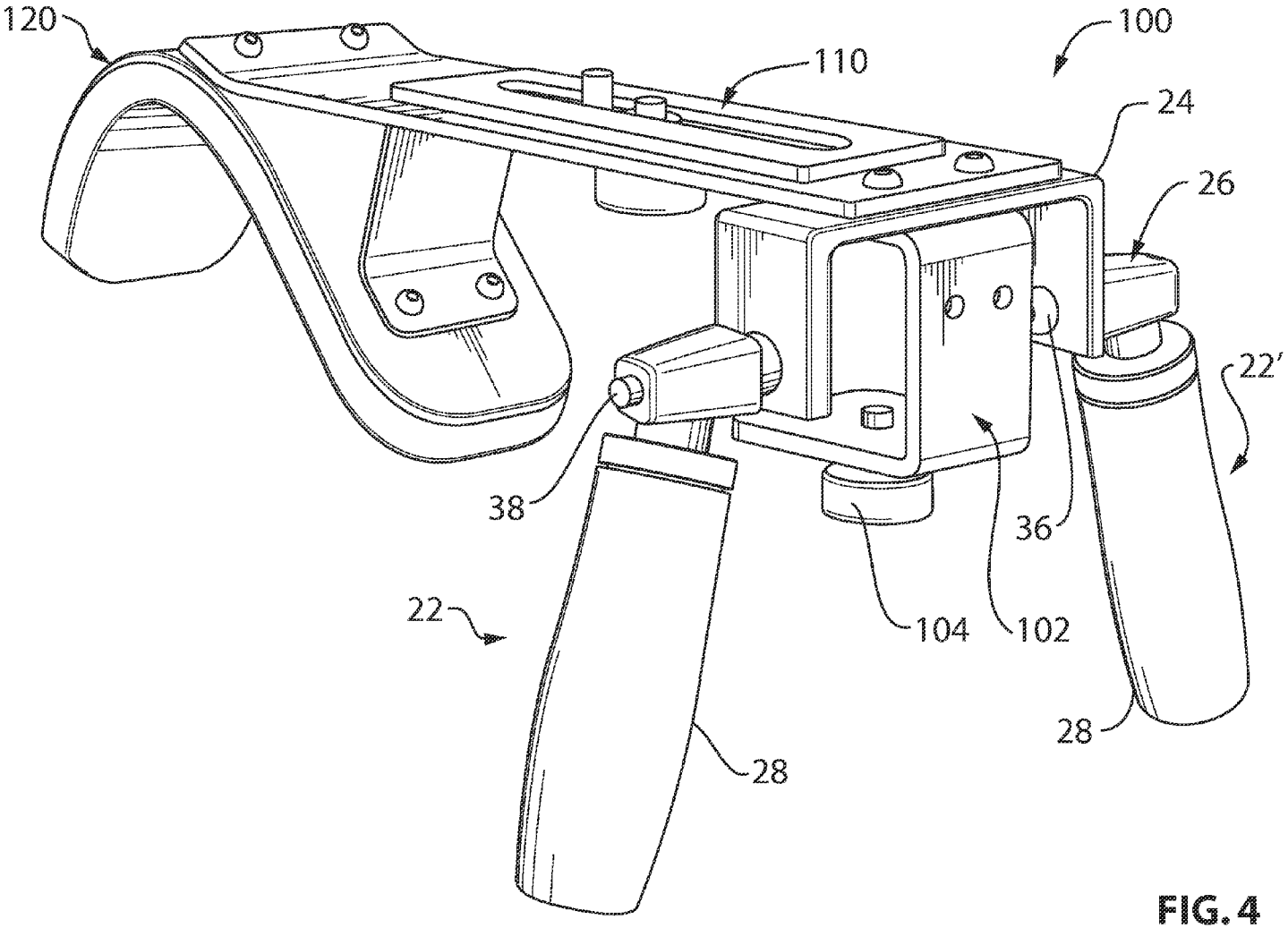
FIG. 4 is a perspective schematic illustration of a camera support with two pivotable handle assemblies in accordance with an embodiment.

FIG. 4 shows a camera support 100 comprising a support 20 with two pivotable handle assemblies similar to handle assemblies 22 and 22' described above with reference to FIGS. 1 to 3.

The support 20 has the support bar 24 and the handle assembles 22, 22' as in FIG. 1. An adjustable secondary support 102 with adjusting knob 104 is mounted below the support bar 24 for added support and adjustability.

A camera platform 110 is mounted over the support bar 24 for supporting camera equipment thereon. Various adjustability and camera retaining elements are provided thereto.

A shoulder mount 120 depends from an end of the platform 110 opposite the support bar 24 and handle assemblies 22, 22'. The shoulder mount 120 is for mounting over a user's shoulder. In this way, the user is able to stably support camera equipment over his/her shoulder, using the handles 28 in any desired orientation; the handles 28 being accessible from a front side of the user, and adjustable in their respective orientations with respect to the support and user.

In one instance, a user is able to adjust the orientation of a handle 28 with a single hand: a thumb pushes on the button 38 to unlock the handle assembly 22, while the remaining fingers grip the handle 28, pull the handle 28 away and rotate it to a desired position. The handle 28 locks into its position at anytime the thumb releases the button 38.

Figure 5:
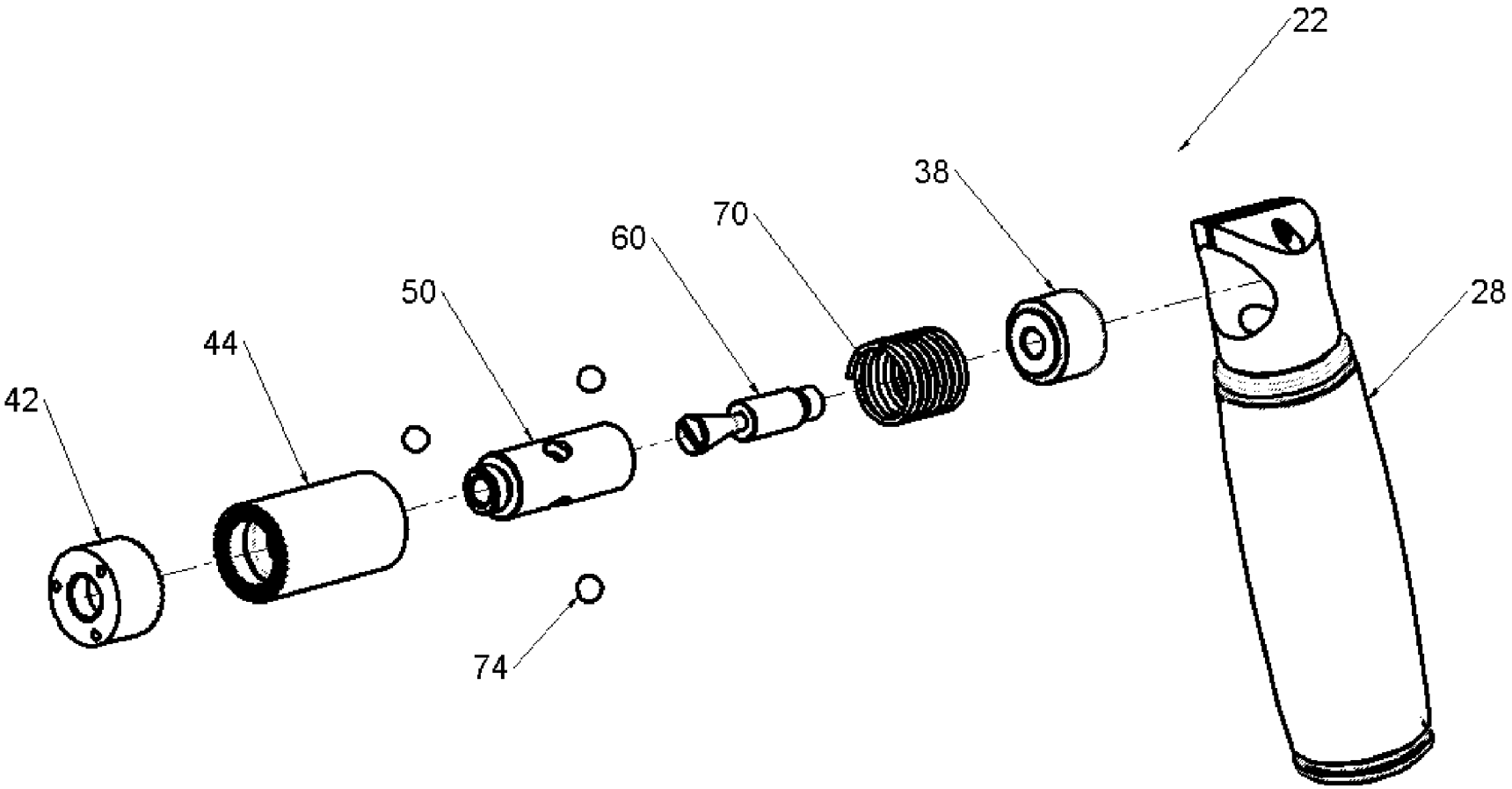
FIG. 5 is a perspective schematic illustration of disassembled components of any one of the pivotable handle assemblies of FIG. 1, in accordance with an embodiment.

FIG. 5 shows disassembled components of any one of the pivotable handle assemblies of FIG. 1, in accordance with an embodiment. Each component is identified with respective reference numerals. As seen, in this case, the plunger 60 is free of the adjusting screw 81.

Figure 6:
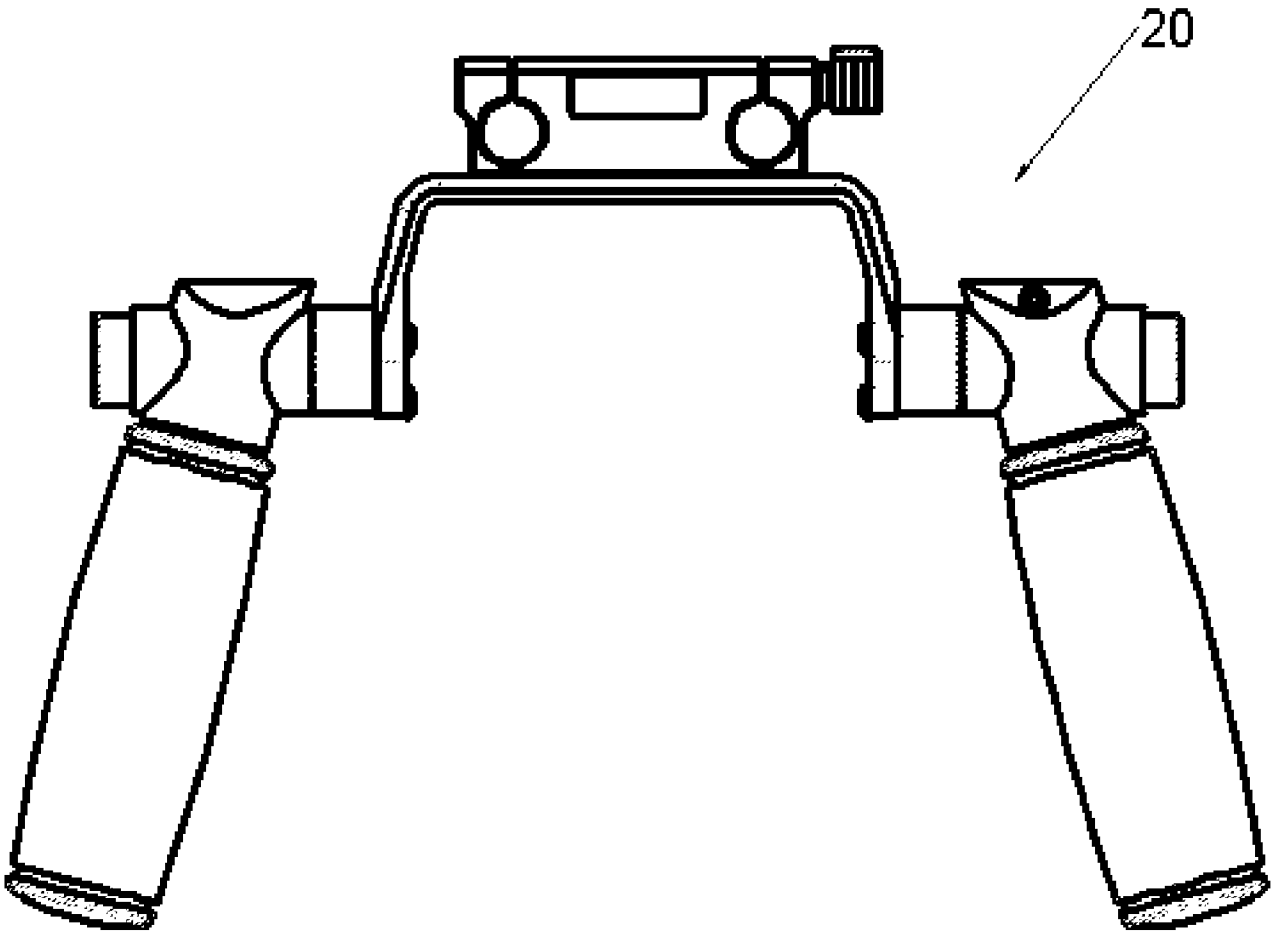
FIG. 6 is a schematic illustration showing a side view of a supporting apparatus in accordance with an embodiment.

FIG. 6 shows an example of a supporting apparatus such as schematically shown in FIG. 1. In this example, an additional mounting device atop support bar 24 is used for attachment with any given equipment or item to be supported thereon.

Figure 7:
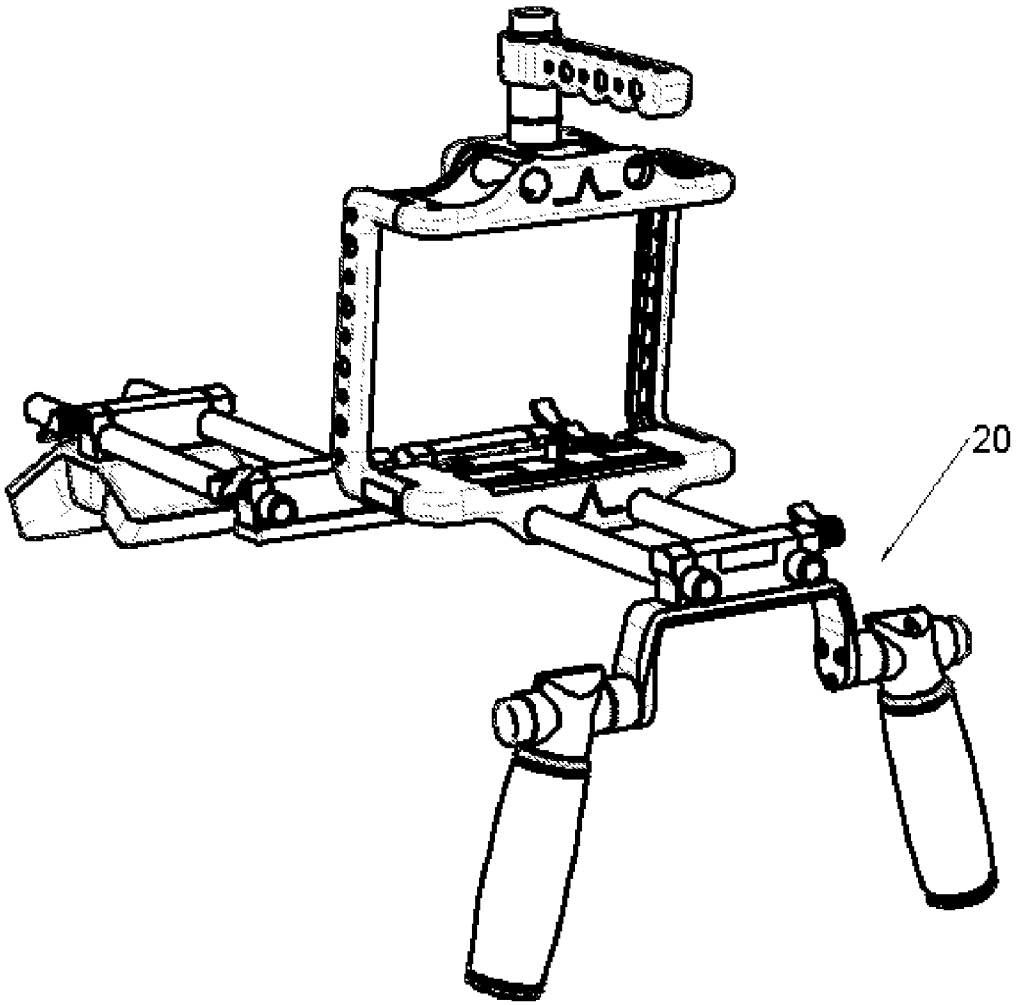
FIG. 7 is a perspective schematic illustration of a camera support in accordance with an embodiment.

Now referring to FIG. 7, which shows an example of a camera support such as shown in FIG. 4. As seen, in this example, the camera support has several additional adjustable support devices, such as a telescopic support bar.

FIGS. 5 to 7 illustrate a specific design of the handle assemblies, whereby the interlocking portions 42, 44 have a cylinder shape.

While preferred embodiments have been described above and illustrated in the accompanying drawings, it will be evident to those skilled in the art that modifications may be made therein without departing from the scope of this disclosure. Such modifications are considered as possible variants comprised in the scope of the disclosure.

The invention claimed is:

1. A pivotable handle assembly for mounting on a support, the assembly comprising:

a rotation-blocking portion comprising a pivot axis, the rotation-blocking portion for being rotatable about the pivot axis and relative to the support when in an unlocked position, and when in a locked position, the rotation-blocking portion for preventing its rotation about the pivot axis;

a handle depending from the rotation-blocking portion; and a locking mechanism comprising a push-button and a lock release, the locking mechanism for locking the rotation-blocking portion in the locked position, and for unlocking the rotation-blocking portion in the unlocked position upon a pushing motion being applied to the push-button to actuate the lock release, the unlocked position thereby allowing the handle to be pivoted about the pivot axis;

wherein the rotation-blocking portion comprises a tube fixed relative to the support, the tube comprising an inner bore, the locking mechanism comprising a plunger having a first end adjacent the push-button and being moveable inside the inner bore from the locked position to the unlocked position upon the pushing motion being communicated to the first end of the plunger via the push-button and wherein the lock release comprises a ball bearing; the inner bore comprises an opening; and the rotation-blocking portion defines an internal recess at least partially communicating with the opening, the ball bearing for moving out of the internal recess and lower into the inner bore upon the pushing motion being applied to the plunger.

2. The assembly of claim 1, wherein the locking mechanism comprises a biasing device for biasing the rotation-blocking portion in the locked position.

3. The assembly of claim 2, wherein the biasing device comprises a spring.

4. The assembly of claim 2, wherein the push-button is partially inserted into the rotation-blocking portion upon the pushing motion being applied thereto, and wherein the rotation-blocking portion comprises a biasing stop, the biasing device being positioned between the push-button and the biasing stop, inside the rotation-blocking portion.

5. The assembly of claim 1, further comprising an interlocking surface for interlocking with a surface of the rotation-blocking portion.

6. The assembly of claim 5, wherein the surface comprises indentations for interlocking with the interlocking surface in the locked position.

7. The assembly of claim 6, further comprising an interlocking portion for mounting to the support, the interlocking portion comprising the interlocking surface.

8. The assembly of claim 6, wherein the rotation-blocking portion is free to be pulled away from the support when in the unlocked position, to thereby allow the surface of the rotation-blocking portion to be released of its interlocking with the interlocking surface of the support.

9. The assembly of claim 1, wherein the plunger comprises an inwardly slanted end opposite the first end, the inwardly slanted end for allowing the ball bearing to move out of the internal recess upon the pushing motion being applied to the plunger.

10. The assembly of claim 9, wherein the inwardly slanted end comprises a cone-shaped end.

11. The assembly of claim 1, wherein the inner bore comprises two opposite ends, one of the two opposite ends comprising a stop at the support, and the other one of the two opposite ends being adjacent the push-button, the stop for stopping the plunger from moving further inside the inner bore and providing a reaction force against the plunger, the reaction force thereby ensuring that the rotation-blocking portion and the handle are free to move relative to the support.

* * * * *